United States Patent [19]

Goans

[11] 4,442,756

[45] Apr. 17, 1984

[54] HEAT SENSITIVE LOCKING DEVICE

[75] Inventor: Kip B. Goans, Harvey, La.

[73] Assignee: Baker Cac, Inc., Belle Chase, La.

[21] Appl. No.: 295,202

[22] Filed: Aug. 24, 1981

[51] Int. Cl.[3] ..... F15B 15/26

[52] U.S. Cl. ..... 92/23; 92/18; 137/75

[58] Field of Search ..... 92/1, 18, 21 R, 21 MR, 92/23, 24, 25, 26, 27, 28; 137/72, 75, 77; 60/635, 636

[56] References Cited

U.S. PATENT DOCUMENTS

| | | | |
|---|---|---|---|
| 2,144,893 | 1/1939 | Parker | 92/25 |
| 2,239,673 | 4/1941 | Fowler | 60/576 |
| 3,463,055 | 8/1969 | Bayles | 92/26 |
| 3,884,125 | 5/1975 | Massie | 92/13.6 |
| 4,014,415 | 3/1977 | Pickel | 92/13.6 |
| 4,093,176 | 6/1978 | Contastin | 92/25 |
| 4,263,839 | 4/1981 | Akkerman et al. | 92/23 |

*Primary Examiner*—Robert E. Garrett
*Assistant Examiner*—Richard S. Meyer
*Attorney, Agent, or Firm*—Norvell & Associates

[57] ABSTRACT

A temperature sensitive locking mechanism is provided for a fluid pressure actuator which will hold the shaft of the actuator in a spring compressing position until the occurrence of a pre-selected temperature in the vicinity of the actuator. Locking threads are provided on the exterior of the actuator, and a latching collet, having a plurality of peripherally spaced, internally threaded, latching arms cooperates with such threads and prevent movement of the actuator shaft by abutting a surface of a stop block which is in abutment with the actuator shaft. The radial faces of the threads are sufficiently angled so as to exert an outwardly directed camming force on the collet latching arms to permit the release of the latch under the axial forces produced by the spring bias on the actuator shaft. The collet latching arms are forcably retained in locked position by an encircling spring wire, the ends of which are connected by a fusible link. Expansion of the wire resulting from the link melting due to temperature increase causes the wire to un-coil and the above to occur.

9 Claims, 4 Drawing Figures

HEAT SENSITIVE LOCKING DEVICE

BACKGROUND OF THE INVENTION

1. Field of the Invention

The invention relates to a locking device having particular utility for use with a fluid pressure actuator. The device can be released from its locked position by the occurrence of an elevated temperature immediate the device.

2. Description of the Prior Art

Temperature released locking mechanisms have heretofore been provided for fluid pressure actuators for valves. Such mechanisms have generally incorporated a mass of fusible material to hold the locking elements of the device in a locked position until the occurrence of an undesirably high temperature immediate the device. Because a relatively large mass of fusible material is employed in such devices, the actuator has to be exposed to the elevated temperature for a substantial time period in order for the mass of the fusible material to be sufficiently heated to cause it to melt and permit the locking device to move to an unlocked position. Moreover, such devices cannot be readily reconstructed in the field after they have once functioned in response to an elevated temperature because of the difficulty of melting and re-applying fusible material.

In U.S. Pat. No. 4,263,839, issued Apr. 28, 1981 and entitled "Heat Sensitive Locking Device", and assigned to the assignee of the instant application, there is disclosed and claimed a heat sensitive locking device wherein a plurality of locking segments are pivotally mounted within a collar for radial movement into locking engagement with a shaftlike element which, in turn, is rigidly secured to the shaft of the fluid pressure actuator. The locking segments are retained in their radially compressed, locked position by the wrapping of a spring wire around the periphery of the locking segments and the securement of the ends of the spring wire by a relatively small mass locking clip of fusible material. Thus, upon the occurrence of an elevated temperature sufficient to cause the small eutectic portion of the locking clip to melt, the spring wire is released and the locking segments are freed to move radially outwardly and permit the actuator to return to the axial position to which it is spring-biased.

While this structure has been effective insofar as providing a reliable and reusable temperature sensitive locking device for an actuator, it is relatively expensive to manufacture due to the large number of components involved in the structure of such device. It also requires a comparatively long time to assemble to an actuator.

There is, therefore, a need for a heat sensitive lock for a fluid pressure actuator utilizing a mechanism that includes a minimum number of component parts that may be readily and quickly assembled to the actuator.

SUMMARY OF THE INVENTION

This invention provides a heat sensitive locking device for an actuator having a shaft which is spring-biased toward one axial position and restrained against such spring-bias by the heat sensitive locking device. The actuator utilizes a plurality of peripherally spaced segments which are internally threaded to cooperate in locking engagement with threads provided on the exterior of the actuator. The axially inboard ends of the locking segments retain a locking plug in a position of abutment against the end face of the actuator shaft to hold the shaft against movement under its applied spring-bias. The locking segments are retained in their locking position by wrapping the exterior surfaces thereof with a spring wire and securing the ends of the spring wire together with a fusible clip.

Upon the occurrence of an elevated temperature immediate the actuator sufficient to cause the relatively small mass fusible clip to melt, the ends of the wire spring are released and the locking segments are moved radially outwardly by virtue of the camming effect of the cooperating threads on the body of the actuator which produce a radially outward displacement of the cooperating threads on the locking segments. The radial outward movement of the locking segments frees the entire locking device from the actuator housing and it moves axially with the actuator shaft to the position to which the actuator shaft is biased by its operating spring.

DESCRIPTION OF THE PREFERRED EMBODIMENTS

Figure 1:
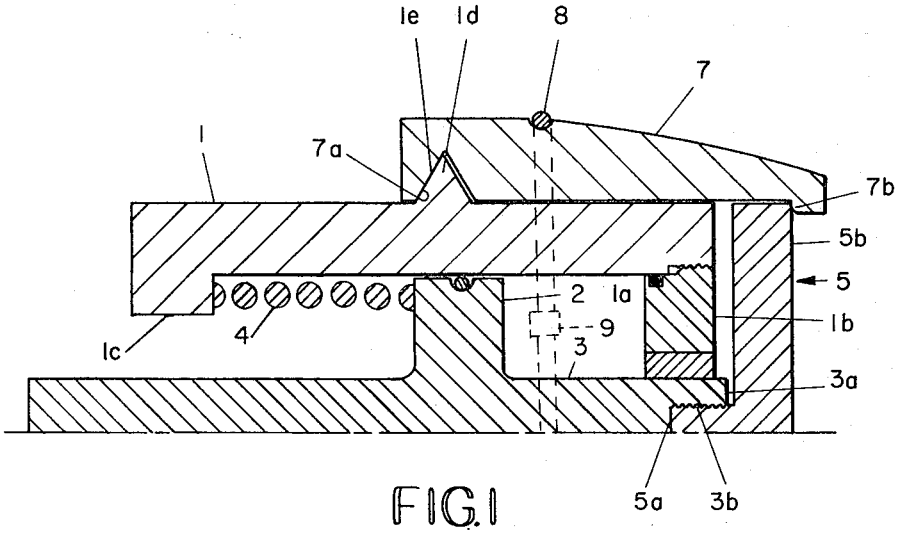
FIG. 1 is a schematic sectional view of a simplified form of heat sensitive locking apparatus illustrating the principles of operation of this invention, with the elements of the heat sensitive lock being shown in their locked position.
Figure 2:
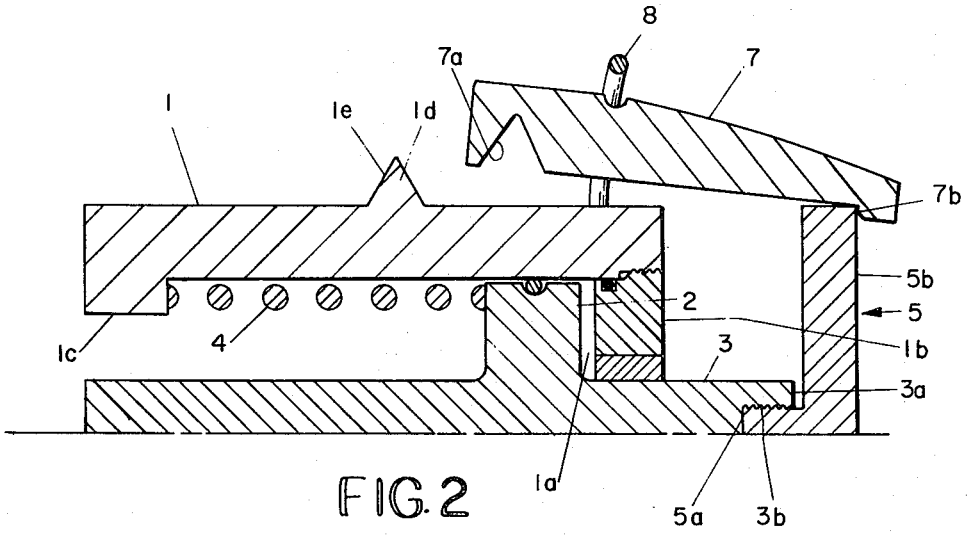
FIG. 2 is a view similar to FIG. 1 but showing the elements of the heat sensitive lock in their released positions.

Referring to FIGS. 1 and 2 in the drawings, there is shown a schematic, highly simplified form of heat sensitive actuator lock constructed in accordance with the principles of this invention. It should be understood that these figures are merely for the purpose of clarifying the operation of the invention, while FIGS. 3 and 4 of the drawings illustrate a practical, operative embodiment of the invention.

Thus, the heat sensitive actuator lock mechanism illustrated in FIGS. 1 and 2 comprises a cylindrical housing 1 defining a fluid pressure chamber 1*a* and a piston 2 cooperable with the inner wall of the housing 1 carried by a shaft 3 having one end portion 3*a* accessible from the exterior of the housing 1 in all axial positions. Housing 1 is closed at one axial end by bearing inserts 1*b* which is sealably secured, as by threads and elastomeric materials, to the interior of the cylindrical housing 1. A spring 4 is provided which is trapped between the piston 2 and a shoulder 1*c*, and in the normal position of the actuator, is compressed to move the accessible end 3*a* of the piston shaft 3 to the position illustrated in FIG. 1 where it is adjacent the one end of the cylindrical housing. Those skilled in the art will recognize that the piston 2 is moved to such spring compressing position through the application of fluid pressure to the side of piston 2 opposite to the spring 4 and that it is often desirable to provide a temperature-sensitive locking mechanism for holding the piston 2 and shaft 3 in such position until the temperature immmediate the actuator rises to a degree requiring the operation of the actuator under the force of the compressed spring 4.

The heat sensitive locking mechanism essentially comprises a stop block 5 of generally cylindrical configuration having an axial projection 5*a* suitably engaged with the end 3*a* of the piston shaft 3, as by threads 3*b*, so as to be axially movable therewith. An external annular latching surface 1*d* is provided on the periphery of the cylindrical housing 1 defining a radially inclined shoulder 1*e*. A latch mechanism is then provided comprising two or more peripherally spaced latching arms 7 having a complimentarily shaped latching surface 7*a* for engagement with the external cylindrical latching suface 1*e* and a force transmitting shoulder 7*b* engaging the outer face 5*b* of the stop block 5 to restrain the axial movement of such stop block and, hence, any axial movement of the piston shaft 3 produced by the compressed spring 4. The angles of the camming surfaces 1*e* and 7*a* are preferably on the order of about 60° so that normally the latch 7 would be cammed radially outwardly by the axial forces imposed on such surfaces by the stop block 5. However, the latch 7 is retained in its locking position by virtue of a spring wire 8 which is wrapped around the periphery of the latch 7 and the ends are secured together by a fusible clip 9. The metal forming the clip 9 is selected to have a melting temperature corresponding to the temperature at which it is desired that the lock be removed from the actuator. Upon a rise in temperature immediate the actuator to a level sufficient to melt the clip 9, the spring wire 8 inherently expands outwardly, permitting the latch 7 to be cammed radially outwardly by the coaction of the camming surfaces 7*a* and 1*e* and the latch is released, permitting the stop block 5, the piston shaft 3 and the piston 2 to move to the position shown in FIG. 2 under the force exerted by the expanding spring 4.

Figure 3:
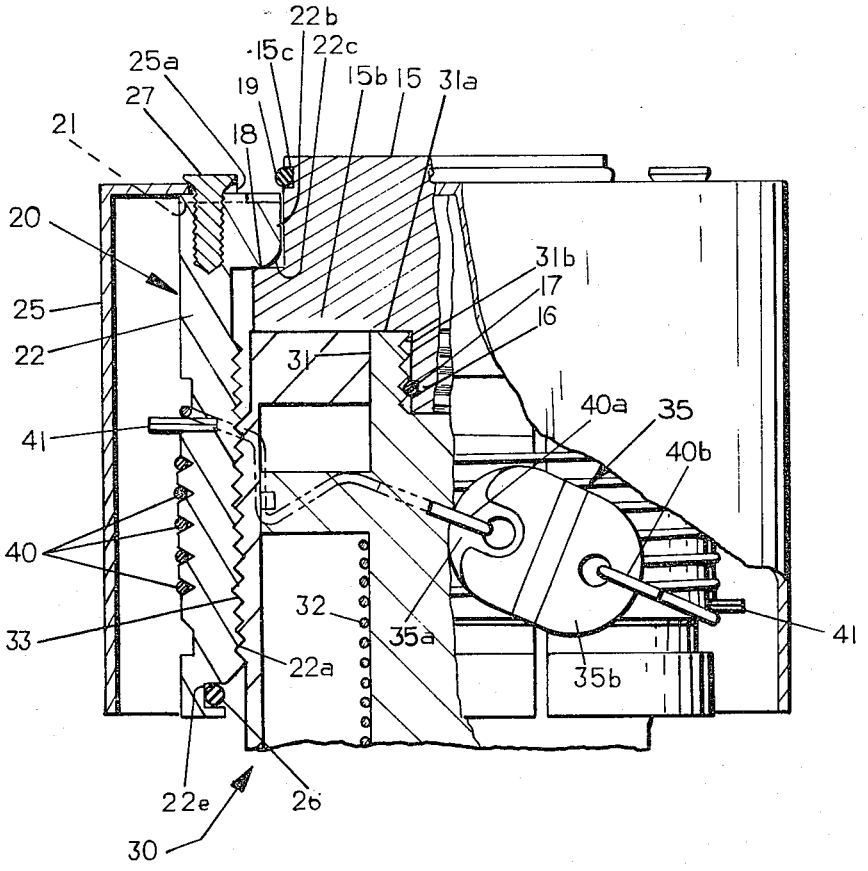
FIG. 3 is a partial sectional view of a heat fusible locking device embodying this invention shown in assembled relationship to a schematically illustrated fluid pressure actuator, with the elements of the locking device shown in their locked position.
Figure 4:
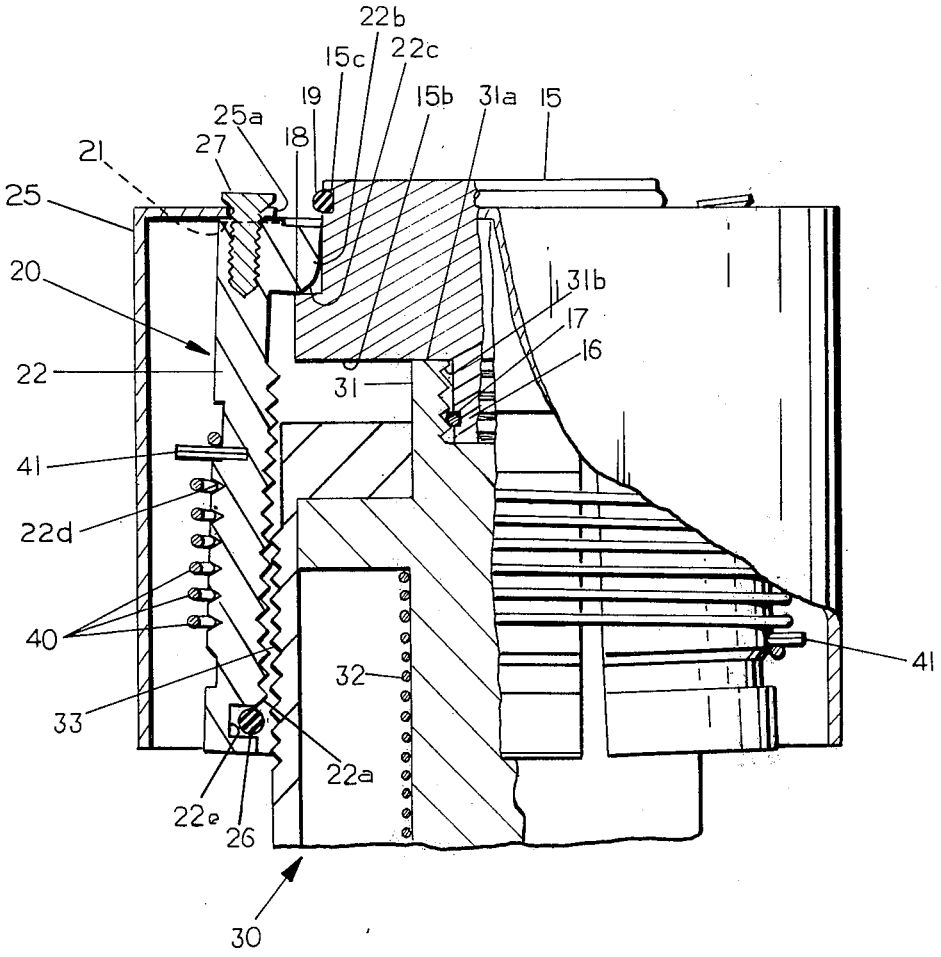
FIG. 4 is a view of the locking device similar to FIG. 3, but showing the elements of the locking device in their unlocked position, permitting spring-biased axial movement of the actuator shaft with respect to the actuator housing.

Referring now to FIGS. 3 and 4, a heat sensitive lock assembly embodying this invention is shown comprising a stop block 15, a latching element 20, and a cover 25. These elements cooperate with a conventional fluid pressure actuator comprising a cylindrical housing schematically indicated at 30 and having a piston shaft 31 with an end face 31*a* accessible exteriorly of the cylinder housing 30 when the actuating spring 32 is compressed. The external annular latching surfaces are defined by a thread 33 provided on the exterior of the cylindrical housing 30 in concentric surrounding relationship to the piston shaft 31. Additionally, the exposed end 31*a* of the piston shaft 31 is provided with internal threads 31*b*.

In order to permit the convenient assembly of the latching mechanism to the fluid pressure actuator 30, the stop block 15 is provided with a generally cylindrical axial protrusion 16 defining an annular groove for reception of an elastomeric O-ring 17. O-ring 17 can then be frictionally engaged with the internal threads 31*b* of the piston shaft 31 through a manual screwing of the stop block 15 into such piston shaft threads. Additionally, the stop block 15 is provided with an external shoulder 18 for transmission of forces exerted by the piston shaft 31 to the latch element 20.

Latch element 20 preferably comprises a collet having a very thin, continuous ring portion 21, formed at its outer end and a plurality of integral, peripherally spaced, internally threaded latching arm portions 22 disposed in surrounding relationship to the threads 33 provided on the exterior of the cylindrical housing 30. The thin ring portion 21 of the collet lock assembly 20 permits the convenient assembly of the collet lock as a unit over the stop block 15 and the threaded portion 33 of the cylinder housing.

Each of the arm portions 22 of the collet 20 are internally threaded, as indicated at 22*a* to provide a mating engagement with the threads 33 on the cylindrical housing 30. The external surfaces of such threads are preferably disposed at an angle of about 60° relative to the thread axis so that the exertion of an axial force on the threads 22*a* of the latch arm 22 will result in a radially outward camming motion of the arms 22 thus releasing such arms from the threads 33 of the cylindrical housing.

Each of the collet arm portions 22 is additionally provided near its outboard axial end with a radially inward abutment portion 22*b* defining a rounded surface 22*c*, the outer portion of which is in abutting engagement with the force-transmitting shoulder 18 provided on the stop block 15. Thus, the latching arms 22 of the collet latching mechanism 20 are free to deflect radially outwardly, such outward movement being accommodated by a resilient deflection of the thin solid ring portion 22*a* and permitted without interference with the stop block 15 by the provision of the rounded corner surface 22*c*.

The movement of the piston 31 under the influence of the spring 32, once the latching arms 22 have been released from the external threads 33, is quite rapid. Hence the stop block 15 and the locking collet 20 are accelerated rapidly in an axial direction. They are, however, abruptly halted by the piston 31 reaching the end of its permitted axial travel and, if no means were provided, the collet 20 would fly off the stop block 15 due to its axial inertia. To prevent such disassembly, the end of stop block 15 is constructed to project entirely through the collet 20 and such projecting end is provided with a peripheral groove 15*c* in which an elastomeric O-ring 19 is secured. O-ring 19 frictionally prevents the collet 20 from moving off the end of the stop block 15 under the influence of inertia forces.

The collet arms 22 are forcibly retained in their latched position relative to the external cylinder threads 33 by the wrapping of a spring wire 40 around the external periphery of the collet arms 22. To facilitate such wrapping, the periphery of collet arms 22 may be provided with helical grooves 22*d* to receive the spring wire 40. The grooves provide a frictional grip between the wire 40 and the collet 22. The opposed ends of the spring wire 40 are respectively wrapped around radial pins 41 and are provided with looped or hooked portions 40*a* and 40*b*, which in turn are connected to two link elements 35*a* and 35*b* which are secured together by a fusible material to form a fusible link 35 that melts and separates at a temperature selected to require the operation of the actuator to its spring pressed extreme position. Upon the melting and separation of the fusible link 35, the retaining wire spring 40 will uncoil due to its inherent resilience, and thus permit the latching arms 22 to be forced radially outwardly by the angular configuration of the cooperating threads 22*a* on the actuating arms 22 and the external cylinder threads 33, due to the axial force imposed upon the latching arms 22 by the stop block 15, and in turn by the piston shaft 31 and the compressed piston spring 32.

A solid ring 26 may be mounted within an annular groove 22*e* provided in the extreme inboard end portions of the collet arms 22. The ring 26 keeps the collet arms 22 from moving inwardly during shipping and handling.

Additionally, a cover 25 of generally inverted cup-shaped, annular configuration may be mounted in surrounding relationship to the collet latching mechanism 30 by a plurality of screws 27 which pass through appropriate slots 25*a* in the top portion of the cover 25 and are threadably engaged with the outboard ends of collet locking arm portions 22.

OPERATION

The latching mechanism, including the stop block 15 and the latching collet 20, are assembled to the cylinder housing threads 33 and the piston threads 31*b* by a simple screwing motion of the latching assembly while the piston 31 is held in its one extreme axial position wherein the spring 32 is fully compressed through the application of fluid pressure to the interior of cylinder 30. Thus, in the initial assembly operation, the application of the latching mechanism is not opposed by any forces generated by the spring 32. Once the actuator has the latching mechanism installed, the fluid pressure on the piston may be released, whereupon the spring 32 will apply a force to the end 31*a* of the piston shaft 31 through the adjacent surface 15*b* of the stop block 15, and the stop block 15 thus transmits an axial force to the locking collet 20 and thence through the locking arms 22 to the threads 33 on the exterior of the cylinder housing 30. So long as the spring 40 maintains the locking arms 22 in snug engagement with the cylinder housing threads 33, the actuator is locked in its spring compressed position. Upon the occurence of an increased temperature in the vicinity of the actuator sufficient to cause the melting and separation of the fusible link 35, the spring 40 will immediately uncoil, the latching arms 22 of collet 20 will be released for radially outward deflection produced by the camming action of the external cylinder threads 33, and the latch mechanism is released, permitting the piston shaft 31 and the attached locking mechanism to move axially to the position illustrated in FIG. 4.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A heat sensitive, fluid pressure actuator, comprising: a housing defining a cylinder chamber; a piston reciprocatingly mounted in said cylinder chamber for movement between two extreme axial positions; resilient means urging said piston to one of said extreme axial positions; said piston having a shaft portion with its end exposed relative to said housing when said piston is in the other of said extreme axial positions; said housing having an external, annular, radially inclined shoulder surrounding said piston shaft portion, and fusible means for securing said piston shaft to said radially inclined shoulder comprising a stop block abutting said exposed piston shaft end; a latch having one end engaging and axially restraining said stop block, said latch having a complementary inclined surface abutting said radially inclined shoulder on said housing, whereby said latch is biased outwardly to a disengaging position by the force of said resilient means; a spring wire element forcibly wrapped around said latch and said housing to retain said latch in latching engagement with said radially inclined shoulder; and a fusible link holding said spring wire element in said wrapped position.

2. A heat sensitive, fluid pressure actuator comprising: a housing defining a cylinder chamber; a piston reciprocatingly mounted in said cylinder chamber for movement between two extreme axial positions; resilient means urging said piston to one of said extreme axial positions; said piston having a shaft portion with its end exposed relative to said housing when said piston is in the other of said extreme axial positions; said housing having an externally threaded portion surrounding said piston shaft portion; a cylindrical stop block abutting said exposed end of said shaft portion; a latching collet mounted on said cylindrical stop block for comovement therewith in an axial direction; said collet having a plurality of peripherally spaced, internally threaded arm portions engagable with said external threads on said housing to lock said piston shaft against axial movement by said resilient means, said housing and collet arm threads being angled to cam said collet arms radially outwardly to release said collet arms from said housing threads by the axial force exerted by said resilient means; and means including a fusible link for retaining said collet arms in engagement with said external housing threads until said fusible link melts.

3. The apparatus of claim 1 or 2 further comprising means for frictionally securing said stop block to said piston shaft.

4. The apparatus of claim 1 or 2 wherein said exposed end of said piston shaft is internally threaded and said stop block has an axial projection thereon insertable in said internal threads; and an elastomeric element mounted on said axial projection and frictionally engaging said internal piston shaft threads.

5. The apparatus of claim 2 wherein a portion of said cylindrical stop block projects axially through said collet arm portions, and an elastomeric element is mounted on said projecting portion of said cylindrical stop block to limit relative axial movement of said latching collet produced by acceleration of said piston shaft after release.

6. The apparatus of claim 2 wherein said collet includes a solid ring portion uniting said arm portions and flexing to permit radial outward movement of said collet arm portions.

7. A heat sensing device mountable upon a fluid pressure actuator, said actuator having a housing defining a cylinder chamber; a piston reciprocatingly mounted in said cylinder chamber for movement between two extreme axial positions; resilient means urging said piston to one of said extreme axial positions, said piston having a shaft portion with its end exposed relative to said housing when said piston is in the other of said extreme axial positions; said housing having an external, annular, radially inclined shoulder surrounding said piston shaft portion, said heat sensitive device comprising: fusible means for securing said piston shaft to said radially inclined shoulder, said fusible means comprising a stop block for abutment with said exposed piston shaft end; a latch having one end engagable and axially restrainable relative to said stop block, said latch having a complementary inclined surface abuttable with said radially inclined shoulder on said housing, whereby said latch is biasable outwardly to a disengaging position by the force of said resilient means; a spring wire element forcibly wrappable around said latch and said housing to retain said latch in latching engagement with said radially inclined shoulder; and a fusible link for holding said spring wire element in said wrapped position.

8. The device of claim 7 further comprising means for frictionally securing said stop block to said piston shaft.

9. The device of claim 7 wherein said exposed end of said piston shaft is internally threadable and said stop block has an axial projection thereon insertable in said internal threads; and an elastomeric element mounted on said axial projection and frictionally engageable with said internal piston shaft threads.

* * * * *